US006707353B1

(12) United States Patent
Yamakawa et al.

(10) Patent No.: US 6,707,353 B1
(45) Date of Patent: Mar. 16, 2004

(54) DIELECTRIC FILTER

(75) Inventors: Takehiko Yamakawa, Osaka (JP); Toru Yamada, Osaka (JP); Toshio Ishizaki, Hyogo (JP); Akira Enokihara, Nara (JP); Minoru Tachibana, Osaka (JP); Toshiaki Nakamura, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 82 days.

(21) Appl. No.: 09/868,651

(22) PCT Filed: Oct. 31, 2000

(86) PCT No.: PCT/JP00/07643

§ 371 (c)(1),
(2), (4) Date: Sep. 14, 2001

(87) PCT Pub. No.: WO01/33661

PCT Pub. Date: May 10, 2001

(30) Foreign Application Priority Data

Nov. 2, 1999 (JP) ..... 11-312006

(51) Int. Cl.[7] ..... H01P 1/20
(52) U.S. Cl. ..... 333/202; 333/219.1
(58) Field of Search ..... 333/202, 219.1, 333/212, 230, 202 DR

(56) References Cited

U.S. PATENT DOCUMENTS 5,714,919 A * 2/1998 Satoh et al. ..... 333/202
5,781,085 A * 7/1998 Harrison ..... 333/202
5,841,330 A * 11/1998 Wenzel et al. ..... 333/202

FOREIGN PATENT DOCUMENTS

| | | |
|---|---|---|
| GB | 2129226 | 5/1984 |
| JP | 52-9336 | 7/1975 |
| JP | 52-9339 | 7/1975 |
| JP | 61-4302 | 1/1986 |
| JP | 62-51804 | 3/1987 |
| JP | 2-141001 | 5/1990 |
| JP | 5-315813 | 11/1993 |
| JP | 9 -205302 | 8/1997 |
| JP | 10303601 | 11/1998 |

OTHER PUBLICATIONS

"High Q TE01 Mode Dr Cavity Filters for Wireless Base Stations", by Liang et al., IEEE MTT–S Digest, 1998, pp. 825–828. Sep. 26, 2002.
"Dielectric Resonator Using Ceramics of High Dielectric Constant", by Yoshihiro, Practical Microwave Circuit–Design, issued by Sogo Denshi Shuppan–sha on Jun. 13, 1996, pp. 124–129.
4.3.6 Dielectric Resonator, by Yashihiro, Method of Constructing High–Frequency Microwave Circuit, issued by Sogo Denshi Suppan–sha on Jun. 20, 1993, pp. 194–199.
English Language Abstract of JP–2–141001.
English Language Abstract of JP–61–4302.
English Language Abstract of JP–62–51804.
English Language Abstract of JP–10–303601.
Patent Abstracts of Japan, vol. 1997, No.12 (Dec. 25, 1997).
Patent Abstracts of Japan, vol. 018, No. 120 (E–1516) (Feb. 25, 1994).

* cited by examiner

*Primary Examiner*—Vibol Tan
(74) *Attorney, Agent, or Firm*—Greenblum & Bernstein, P.L.C.

(57) ABSTRACT

In order to prevent filter characteristics from being deteriorated due to generation of a spurious pulse is unnecessary resonance at a high level in a passing band at the frequency in a microwave region used in a portable telephone system or the like, at least two types of dielectric resonators having different frequency characteristics in unnecessary harmonic modes except for a main mode near the passing band of a filter are arranged in spaces partitioned by partition walls in a shielding unit constituted by a metal case and a lid, so that a dielectric filter which can obtain preferable spurious suppressing characteristics.

7 Claims, 8 Drawing Sheets

Fig.1 ( a )
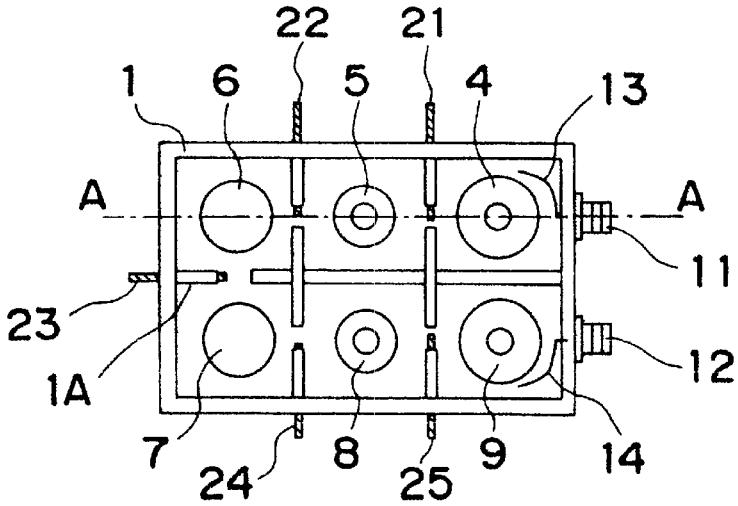
Fig.1 ( b )
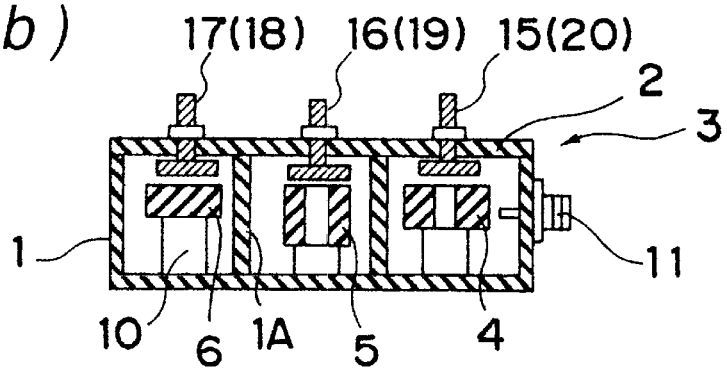
Fig.1 ( c )
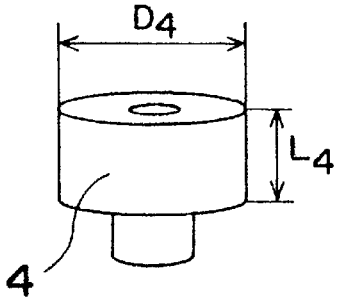
Fig.1 ( d )
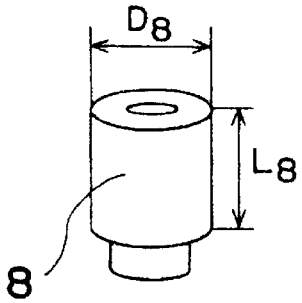

WHEN εr = 35.0

Fig.3 ( a )
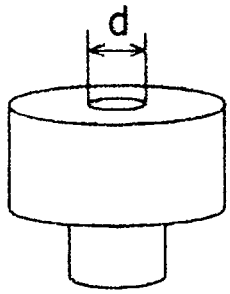
Fig.3 ( b )
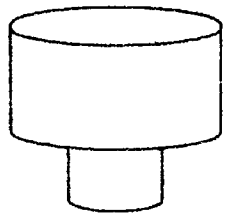
Fig.4 ( a )
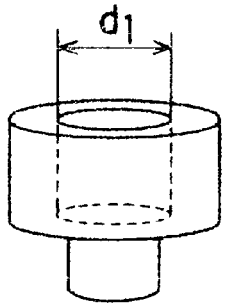
Fig.4 ( b )
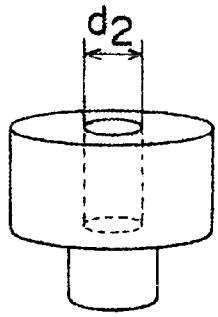
Fig.5 ( a )
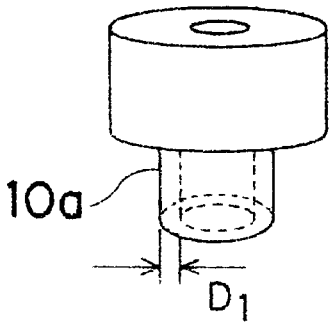
Fig.5 ( b )
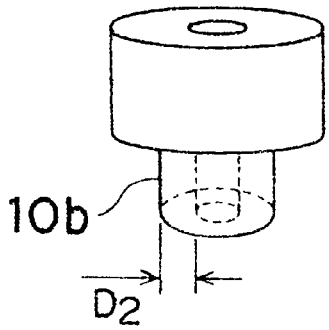

Fig.6
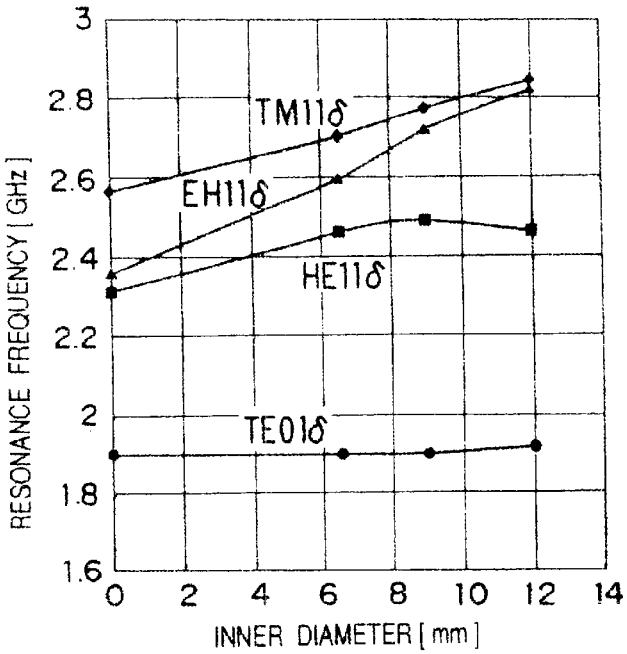
Fig.7 ( a )
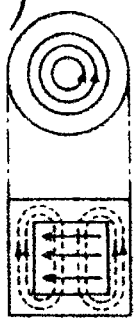
$TE^{0}_{01\delta}$ MODE
Fig.7 ( b )
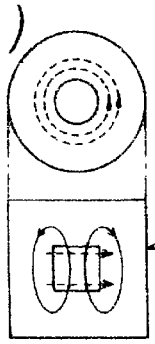
$TM_{01\delta}$ MODE
Fig.7 ( c )
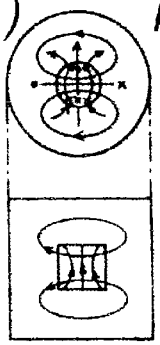
$EH_{11\delta}$ MODE
Fig.7 ( d )
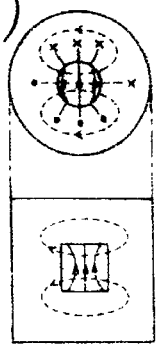
$HE_{11\delta}$ MODE
—— ELECTRIC FIELD
---- MAGNETIC FIELD Fig.12 ( a )
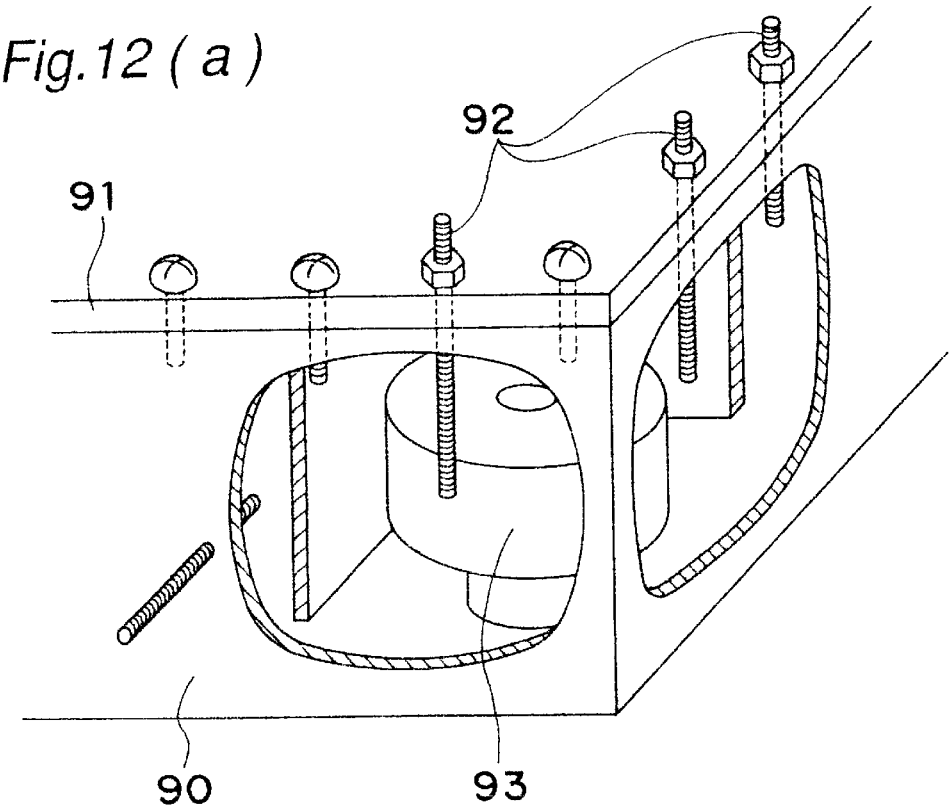
Fig.12 ( b )
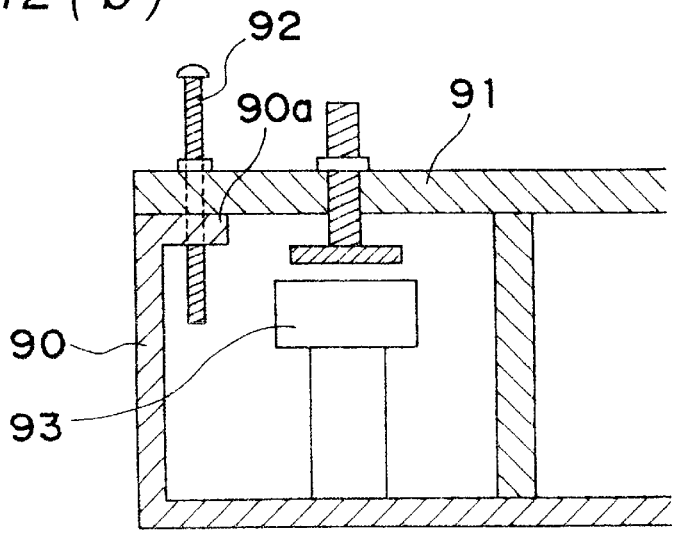

Fig.13 ( a )
PRIOR ART
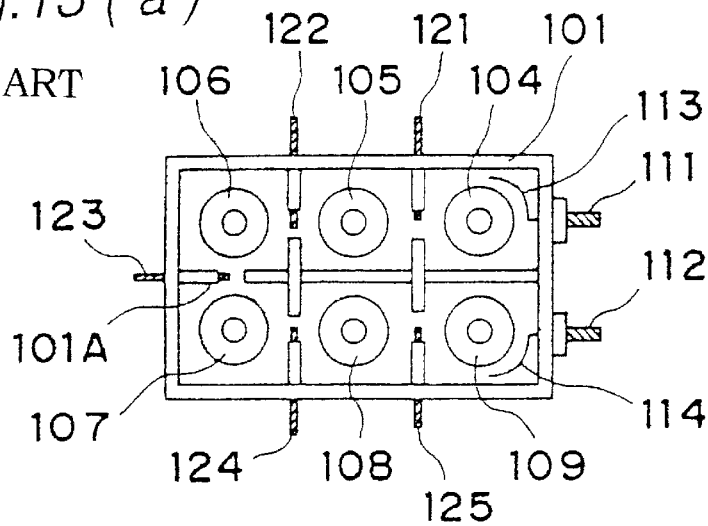
Fig.13 ( b )
PRIOR ART
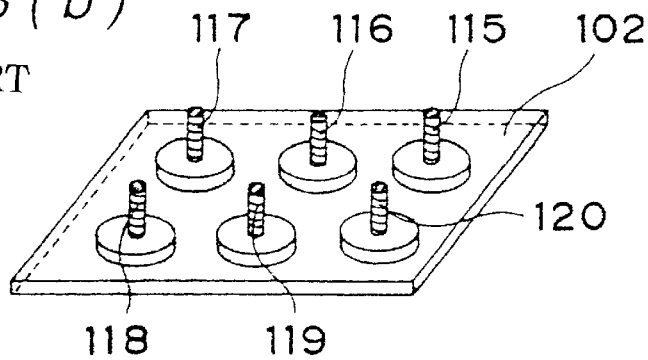
Fig.13 ( c )
PRIOR ART
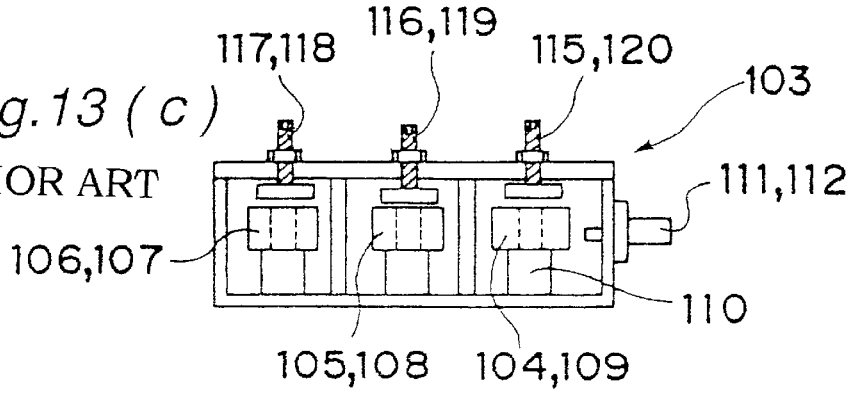

DIELECTRIC FILTER

TECHNICAL FIELD

The present invention relates to a dielectric filter which can obtain preferable spurious suppressing characteristics in a microwave region used in a base station of a portable telephone system and, more particularly, to a dielectric filter obtained by combining dielectric resonators having different frequency characteristics in unnecessary harmonic wave modes to efficiently suppress a spurious generated near a desired pass band.

1. Background Art

In recent years, low-loss filters having high stability are variously used to achieve a reduction in size and an increase in reliability of devices in high-frequency bands. In particular, a dielectric filter using a dielectric resonator is popularly used as a narrow-band and low-loss band-pass filter.

As a dielectric filter of this type using a dielectric resonator, for example, a $TE_{01}$ mode filter disclosed in IEEE MTT-S INTERNATIONAL MICROWAVE SYMPOSIUM DIGEST WEIF-13 "HIGH Q TE01 MODE DR CAVITY FILTERS FOR WIRELESS BASE STATIONS" (issued in 1998) is known. Rough configurations of this filter are shown in FIGS. 13(*a*) to 13(*c*).

2. Prior Art

In FIGS. 13(*a*) to 13(*c*), separate spaces partitioned at predetermined intervals with electromagnetic coupling windows by partition walls 101A of the same material as that of the case 101 are formed in a shield unit 100 constituted by a cavity metal case 101 for forming a shield housing and a metal lid 102, and a plurality of dielectric resonators 104 to 109 electromagnetically coupled to each other and having the same shapes are formed on support tables 110 in the separate spaces, respectively. Input/output connectors 111 and 112 are attached to one end portion of the shield unit 103, and a probe 113 electromagnetically coupled to the dielectric resonator 104 is arranged on the connector 111, and a probe 114 electromagnetically coupled to the dielectric resonator 109 is arranged on the connector 112. On the lid 102, at the positions of the dielectric resonators 104 to 109, tuning plates 115 to 120 constituted by metal screws and plates are arranged, respectively, and the plate positions are adjusted to thereby adjust resonance frequencies of the respective dielectric resonators. Reference numerals 121 to 125 shown in FIG. 13(*a*) denote adjusting screws for adjusting electromagnetic couplings, and the adjusting screws adjust electromagnetic couplings between adjacent dielectric resonators.

In the configuration of the conventional dielectric filter described above, by high-order mode resonance, high-level unnecessary resonance (to be referred to as a "spurious pulse" hereinafter) is generated at the same frequency outside a passing band to disadvantageously deteriorate filter characteristics. In addition, when a low-pass filter is loaded to suppress the spurious pulse, the low-pass filter requires sharp characteristics, and the number of stages of the filters increases to increase the insertion loss of the low-pass filter. That is, the insertion loss of the entire filter increases. The present invention is to solve the above problem, and has as its object to provide a dielectric filter which can suppress a spurious pulse and can reduce insertion loss.

DISCLOSURE OF THE INVENTION

In order to achieve the object, the present invention provides a dielectric filter in which, as a combination of dielectric resonators having different frequency characteristics in unnecessary harmonic modes, dielectric resonators having at least two types of different shapes or different dielectric constants are arranged in a metal shielding unit, so that an electromagnetic field distribution is changed to efficiently suppress a spurious pulse near a desired passing band.

The first aspect of the present invention is a dielectric filter having a metal case, a lid, and a plurality of dielectric resonators arranged through support tables in spaces partitioned by a metal partition wall inside the metal case and characterized in that the dielectric filter is constituted by a combination of at least two types of dielectric resonators having different frequency characteristics in unnecessary harmonic modes except for a main mode near a passing band of the filter. With the above configuration, a spurious pulse can be extremely effectively suppressed.

The second aspect is characterized in that, in the first aspect, the dielectric resonators having different frequency characteristics in the unnecessary harmonic modes are constituted by a combination of dielectric resonators having at least two types of different shapes.

The third aspect is characterized in that, in the second aspect, the dielectric resonators are dielectric resonators having at least two types of different aspect ratios.

The fourth aspect is characterized in that, in the second aspect, the dielectric resonators are constituted by a dielectric resonator which has an inner hole and a dielectric resonator which has no inner hole.

The fifth aspect is characterized in that, in the second aspect, the dielectric resonators have inner holes having at least two types of different diameters.

The sixth aspect is characterized in that, in the first aspect, the dielectric resonators having the different frequency characteristics in the unnecessary harmonic modes are constituted by a combination of dielectric resonators having at least two types of different dielectric constants.

The seventh aspect of the present invention is characterized in that, in the first aspect, the plurality of dielectric resonators are held by cylindrical support tables having at least two types of different thickness.

The eighth aspect of the present invention is characterized in that, in the first aspect, the plurality of dielectric resonators are constituted by a combination of at least two types of at least two types of different aspect ratios, diameters of inner holes, dielectric constants, and thickness of cylindrical support tables.

The ninth aspect of the present invention is characterized in that, in the first aspect, the metal case forming the dielectric filter and at least one of input/output terminals are connected through a duct integrated with the metal case, and a low-pass filter is formed in the duct. With this configuration, since the dielectric filter and the low-pass filter are connected to each other without a connector, a reduction in insertion loss and a reduction in cost can be extremely effectively achieved.

The tenth aspect of the present invention is characterized in that, in the ninth aspect, the duct has an outer diameter different from the outer diameter of a cable duct used for the input/output terminals.

The eleventh aspect of the present invention is characterized in that, in the first aspect, in the dielectric filter, tuning plates for adjusting the resonance frequencies of the dielectric resonators and a metal rod member are adjustably inserted at remote positions from the dielectric resonators and near the metal case.

The twelfth aspect of the present invention is characterized in that, in the eleventh aspect, the metal rod member is a metal screw which is inserted through a screw hole for connecting the metal case and the lid.

According to the present invention, dielectric resonators having at least two types of different shapes or different dielecrtic constants are arranged in spaces partitioned by a partition wall in a shielding unit constituted by a metal case and a lid, whereby excellent spurious suppressing characteristics can be obtained, and insertion loss can be reduced.

BRIEF DESCRIPTION OF DRAWINGS

FIG. 1(*a*) is a plan view of a dielectric filter according to the first embodiment of the present invention, FIG. 1(*b*) is a sectional view of the dielectric filter according to the first embodiment of the present invention, and FIGS. 1(*c*) and 1(*d*) are perspective views of the dielectric filter and a dielectric resonator according to the first embodiment of the present invention;

FIGS. 3(*a*) and 3(*b*) are perspective views of dielectric resonators used in a dielectric filter according to the second embodiment of the present invention;

FIGS. 4(*a*) and 4(*b*) are perspective views of dielectric resonators used in a dielectric filter according to the third embodiment of the present invention;

FIGS. 5(*a*) and 5(*b*) are perspective views of dielectric resonators used in a dielectric filter according to the fourth embodiment of the present invention;

FIG. 6 is a graph showing a mode chart to diameters of inner holes of resonators according to the present invention;

FIGS. 7(*a*), 7(*b*), 7(*c*), and 7(*d*) are diagrams for explaining electromagnetic field distributions in respective modes of a resonator;

FIGS. 12(*a*) and 12(*b*) are a perspective view of a dielectric filter according to the eighth embodiment of the present invention and a sectional view of a main part of the dielectric filter; and FIG. 13(*a*) is a plan view of a conventional dielectric filter, FIG. 13(*b*) is a schematic perspective view of a lid of a conventional dielectric filter, and FIG. 13(*c*) is a sectional view of a conventional dielectric filter.

BEST MODE FOR CARRYING OUT THE INVENTION

Figure 2:
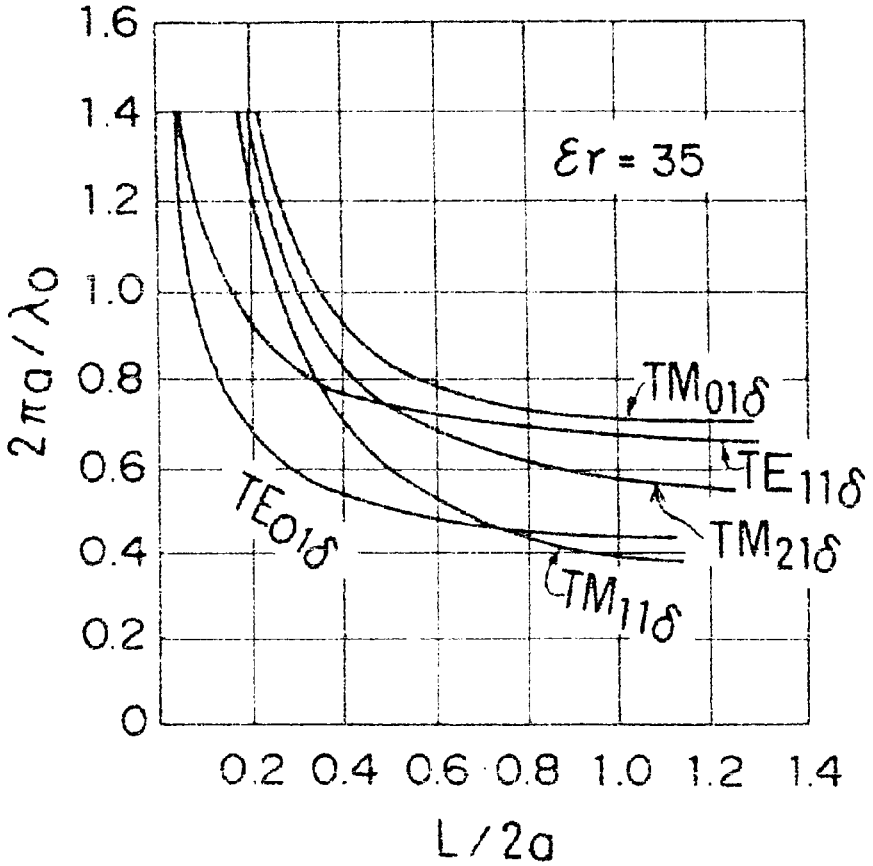
FIG. 2 is a mode chart showing relationships between aspect ratios and resonance frequencies of respective modes.

A dielectric filter according to the present invention employs a $TE_{01\delta}$ mode as a main mode. In general, in a dielectric resonator surrounded by a metal case, in addition to the $TE_{01\delta}$ mode serving as a main mode, various modes such as a TM mode, EH mode, and HE mode are distributed. The dielectric filter employs the $TE_{01\delta}$ mode as a main mode among these modes to constitute the filter. However, the resonator takes not only the $TE_{01\delta}$ mode serving as a main mode but also other modes. This causes generation of a spurious pulse. The $TE_{01\delta}$ mode is the lowest-order mode of the TE modes, and has characteristics in which a Q-value representing the performance of the resonator is very high and performance is very high. For this reason, the $TE_{01\delta}$ mode is popularly used in base stations or the like.

The resonance frequencies of general dielectric resonators are set to be equal to frequencies of a passing band serving as a predetermined filter. In this manner, the shape of the dielectric resonator, the dielectric constant of the constituent material of the dielectric resonator, and the like are determined. However, with respect to the resonance frequency of the dielectric resonator, the same desired resonance frequency can be obtained even though the shape such as an aspect ratio of the dielectric resonator or the dielectric constant of the constituent material are slightly changed. On the other hand, a spurious pulse is affected by the aspect ratio of the dielectric resonator, diameter of an inner hole thereof, and the shape such as a thickness of a support table, and also has the following characteristics that the spurious pulse is affected and changed by the dielectric constant or the like of the constituent material.

By using the spurious characteristics, in the configuration of the dielectric filter of the present invention, it is attended that a spurious frequency can be shifted while a desired passing band and resonance frequencies are equal to each other. At least two types of dielectric resonators having different frequency characteristics in unnecessary harmonic modes except for a main mode near the passing band of the filter are combined to each other to constitute a dielectric filter. As will be described below, the levels of all spurious pulses are suppressed so as to make it possible to obtain high filter characteristics.

Embodiment 1

Embodiments of the present invention will be described below with reference to the drawings. FIGS. 1(*a*) to 1(*d*) show the configuration of a dielectric filter according to the first embodiment of the present invention. FIG. 1(*a*) is a plan view showing the interior of the dielectric filter according to this embodiment without a lid, FIG. 1(*b*) is a sectional view of the dielectric filter along an A—A line in FIG. 1(*a*), and FIGS. 1(*c*) and (*d*) are perspective views for explaining the aspect ratios of dielectric resonators used in this embodiment. In this case, the "aspect ratio" mentioned in the present invention means a ratio (L/D) of a diameter D to a height L of a dielectric resonator.

As shown in FIGS. 1(*a*) and 1(*b*), in a shielding unit 3 constituted by a metal case 1 and a metal lid 2 for forming a shield housing, a total of six dielectric resonators 4 to 9 of the $TE_{01\delta}$ mode arranged in, e.g., two columns are arranged through support tables 10 in separate spaces partitioned at predetermined intervals by partition walls 1A except for coupling windows, respectively. Input/output connectors 11 and 12 are attached to one end portion of the shield unit 3. A probe 13 electromagnetically coupled to the dielectric resonator 4 is arranged on the connector 11, and a probe 14 electromagnetically coupled to the dielectric resonator 9 is arranged on the connector 12.

On the lid 2, at the positions of the dielectric resonators 4 to 9, tuning plates 15 to 20 constituted by metal screws and plates are arranged, respectively. The height positions (the degrees of closeness) of the plates with respect to the dielectric resonators 4 to 9 are adjusted to adjust the resonance frequencies of the dielectric resonators. Reference numerals 21 to 25 shown in FIG. 1(*a*) denote adjusting screws for adjusting electromagnetic couplings. The adjusting screws 21 to 25 are inserted into the coupling windows through the respective partition walls 1A, and the lengths of insertion of the adjusting screws are adjusted, so that the electromagnetic couplings between adjacent dielectric resonators are adjusted.

The configuration of the dielectric filter according to the present invention is different from the conventional configuration in that the dielectric resonators 4 to 9 include a combination of at least two different dielectric resonators in shape. More specifically, in the first embodiment of the present invention, as shown in FIGS. 1(*c*) and 1(*d*), a combination of dielectric resonators having two different shapes, e.g., the dielectric resonator 4 having an aspect ratio L4/D4 and the dielectric resonator 8 having an aspect ratio L8/D8 is used.

FIGS. 1(*c*) and 1(*d*) show the shapes and aspect ratios of the dielectric resonators 4 and 8. However, the present invention is limited to this example. In the dielectric resonators 4 to 9 used in a 6-stage filter to be described in this embodiment, when arbitrary resonators having at least two different aspect ratios are combined to each other, a spurious pulse can be sufficiently suppressed, and the object of the present invention can be achieved in a range in which excellent filter characteristics can be obtained.

The following describes the reason why only a spurious frequency can be changed by changing an aspect ratio while the frequency in the $TE_{01\delta}$ mode is kept at the same value.

As a mode chart, as shown in FIG. 2, for example, by using a mode chart of a dielectric resonator when the dielectric constant $\epsilon_r$=35.0 disclosed in Konishi Yoshihiro "Practical Microwave Circuit Guide—Point and Think of Design—(see p. 125)" (issued by Sogo Denshi Shuppansha), when aspect ratios L/D are given by two types of aspect ratios, e.g., 0.2 and 0.4, and the resonance frequency in the $TE_{01\delta}$ mode is constant, different outer diameters D=2a (a is a radius) are uniquely determined. In this case, the modes except for the $TE_{01\delta}$ mode have mode distributions different from the mode distribution of the $TE_{01\delta}$ mode. For this reason, when aspect ratios L/2a are, e.g., 0.2 and 0.4, and when the resonance frequencies in the $TE_{01\delta}$ mode are set to be equal to each other, the resonance frequencies in the other modes are different from each other. More specifically, when the resonators having different aspect ratios are combined to each other as described above to obtain a multi-stage configuration, spurious frequencies can be dispersed. Therefore, the spurious frequencies can be shifted while a desired passing band is equal to the resonance frequencies, and a spurious level can be suppressed as filter characteristics.

Embodiment 2

Different points between the second embodiment of the present invention and the first embodiment will be described below while the detailed description of the same points will be omitted.

FIGS. 3(*a*) and 3(*b*) show examples of the shapes of dielectric resonators used in this embodiment. FIG. 3(*a*) shows a cylindrical dielectric resonator having an inner hole of a diameter d at the central portion, and FIG. 3(*b*) shows the shape of a column resonator (diameter d of inner hole d=0) in which the inner hole is not formed. In this embodiment, as the shape of the resonator shown in FIG. 3(*a*), a size, i.e., an outer diameter of 27 mm, an inner diameter of 6.5 mm, and a height of 11.9 mm are used. As the shape of the resonator shown in FIG. 3(*b*), a size, i.e., an outer diameter of 27 mm, an inner diameter of 0 mm, and a height of 11.6 mm are used. As the materials, materials each having a dielectric constant of 43 are used. With this configuration, the spurious frequency can be shifted while the desired passing band and the resonance frequencies are equal to each other, and a spurious pulse can be effectively suppressed. The shapes and sizes represented by the above numeral values are only examples, and the present invention is not limited to numeral sizes described above.

Embodiment 3

Different points between the third embodiment of the present invention and the first embodiment will be described below while the detailed description of the same points will be omitted.

FIGS. 4(*a*) and 4(*b*) show examples of the shapes of dielectric resonators used in this embodiment. FIG. 4(*a*) shows a cylindrical dielectric resonator having an inner hole of a diameter d1 at the central portion, and FIG. 4(*b*) shows a cylindrical resonator having an inner hole having a diameter d2 (d1≠d2). As described above, in this embodiment, when the cylindrical dielectric resonators in which the inner holes having at least two types of different diameters are formed are incorporated in a shielding unit, a dielectric filter having a multi-stage configuration is obtained. In this embodiment, as the shape of the resonator shown in FIG. 4(*a*), a size, i.e., an outer diameter of 27 mm, an inner diameter of 12 mm, and a height of 14.2 mm are used. As the resonator shown in FIG. 4(*b*), the same resonator as shown in FIG. 3(*a*) is used. As the materials of the resonators, materials each having a dielectric constant of 43 are used. With this configuration, the spurious frequency can be shifted while a desired passing band and resonance frequencies are equal to each other, and a spurious pulse can be effectively suppressed. The shapes and sizes represented by the above numeral values are only examples, and the present invention is not limited to numeral sizes described above.

Embodiment 4

Different points between the fourth embodiment of the present invention and the first embodiment will be described below while the detailed description of the same points will be omitted.

FIGS. 5(*a*) and 5(*b*) show examples of the shapes of support tables for supporting dielectric resonators used in this embodiment. The dielectric filter of this embodiment is different from the dielectric filter according to each of the above embodiments in that thickness D1 and D2 corresponding to halves of the differences between the inner holes of the central portion formed in support tables 10*a* and 10*b* and the outer diameters of the support tables 10*a* and 10*b* are different from each other. The thickness D1 and D2 of the support tables shown in FIGS. 5(*a*) and 5(*b*) can be designed to be most effective values for suppressing a spurious pulse. For example, in a multi-stage filter having a 6-stage configuration, the support tables have at least two types of different thickness. With the configuration described above, the spurious frequency can be shifted while a desired passing band and resonance frequencies are equal to each other, and a spurious pulse can be effectively suppressed.

The following describes the reason why a spurious frequency can be changed by the presence/absence of inner holes of resonators, the diameters of the inner holes, the thickness of the support tables, and the like in the resonators described in the second to fourth embodiments shown in FIGS. 3 to 5.

FIG. 6 shows a mode chart for the diameter of the inner hole of a resonator when the resonance frequency in the $TE_{01\delta}$ mode of the resonator is constant. It is understood that a spurious frequency changes in another mode as the inner diameter is increased.

FIGS. 7(*a*)–7(*d*) show electromagnetic field distributions in respective modes of resonances disclosed in Konishi Yoshihiro "Method of Constituting High-frequency wave—Microwave Circuit (see p. 196)" (issued by Sogo Denshi Shuppan-sha on June, 1993). As is apparent from the drawings, electric fields are offset from the centers of the resonators in the $TE_{01\delta}$ modes shown in FIGS. 7(*a*) and 7(*b*), but electric fields pass through the centers of the resonators in an $EH_{11\delta}$ mode (FIG. 7(*c*)) and an $HE_{11\delta}$ mode which are close to each other. When an inner hole is formed in the center through which the electric field passes, and when the inner diameter of the hole is changed, an electromagnetic field distribution in this mode is disturbed to change a resonance frequency. When resonators having different inner diameters are combined to each other to form a multi-stage configuration, spurious frequencies can be dispersed, and a spurious level can be suppressed as filter characteristics.

A dielectric filter can be formed by appropriately combining the different shapes of the dielectric resonators used in the first to fourth embodiments of the present invention. By these combinations, a spurious pulse generated in a band except for a passing band required in a frequency band of 30 MHz to 13 GHz can be suppressed, and excellent frequency characteristics can be obtained.

Embodiment 5

The fifth embodiment of the present invention will be described below. In each of the dielectric filters according to the first to fourth embodiments of the present invention, a plurality of dielectric resonators or a plurality of support tables having at least two types of different shapes are combined to each other to suppress a spurious pulse. However, in the fifth embodiment, dielectric resonators are made of constituent materials having a plurality of different dielectric constants ($\epsilon_r$) by changing the constituent materials of the dielectric resonators, and the dielectric resonators are combined to each other to form a dielectric filter.

With respect to the relationship between a dielectric constant and resonance frequencies, for example, when the dielectric constant is high, and when the resonance frequencies in the $TE_{01\delta}$ modes of the resonators are equal to each other, the shapes of the resonators become small. Some resonance frequency in another mode is mainly regulated by the elements of the outer diameter of the resonators. When the dielectric constant is changed, the resonance frequency in this mode changes. In this manner, the spurious frequencies can be dispersed, and a spurious level can be suppressed as filter characteristics.

In this embodiment, a plurality of dielectric resonators each having a dielectric constant of 35 and a plurality of dielectric resonators each having a dielectric constant of 45 are combined to each other, so that a spurious frequency is shifted while a desired passing band and resonance frequencies are equal to each other. As the composition of a material having a dielectric constant $\epsilon_r$=35, a composition represented by e.g., a $ZrO_2$—$TiO_2$—$SnO_2$ base can be used. As the composition of a material having a dielectric constant $\epsilon_r$=43, a composition represented by e.g., a $ZrO_2$—$TiO_2$—MgO—$Nb_2O_5$ base can be used.

Embodiment 6

The sixth embodiment of the present invention will be described below. In a dielectric filter according to this embodiment, the dielectric resonators having different shapes used in the first to fourth embodiments of the present invention and/or dielectric resonators having different dielectric constants used in the fifth embodiment are appropriately compositely used to obtain excellent spurious suppressing characteristics. Here, in the first to sixth embodiment, 6-stage configurations are illustrated as multi-stage filters. However, the present invention is not limited to the configuration, and is realized by combining a plurality of dielectric resonators to each other.

Figure 8:
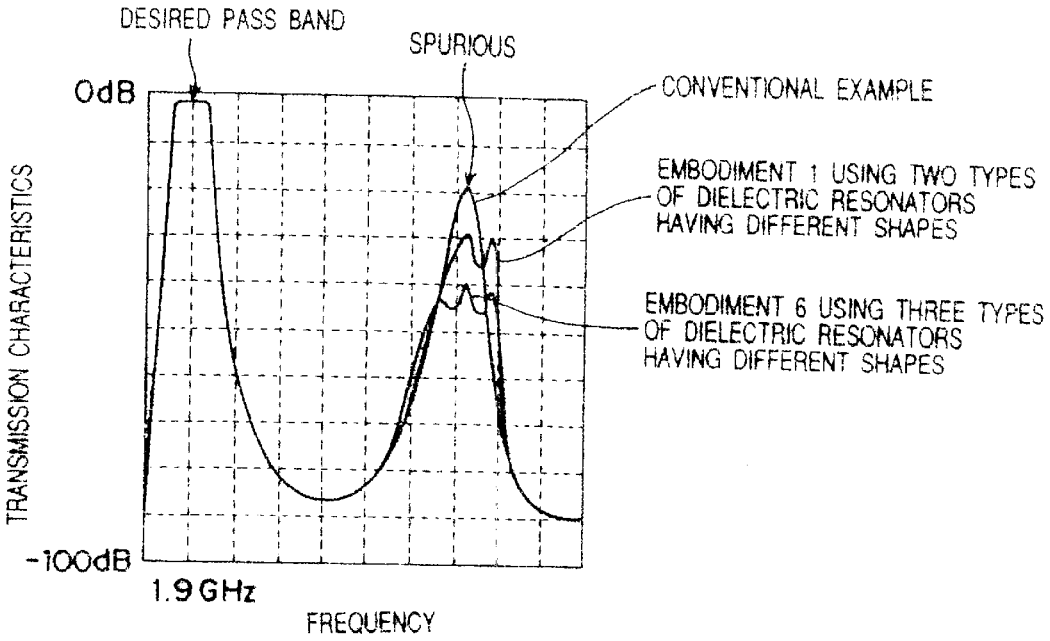
FIG. 8 is a graph for comparing the frequency characteristics of dielectric filters according to the present invention with a conventional frequency characteristic.
Figure 10:
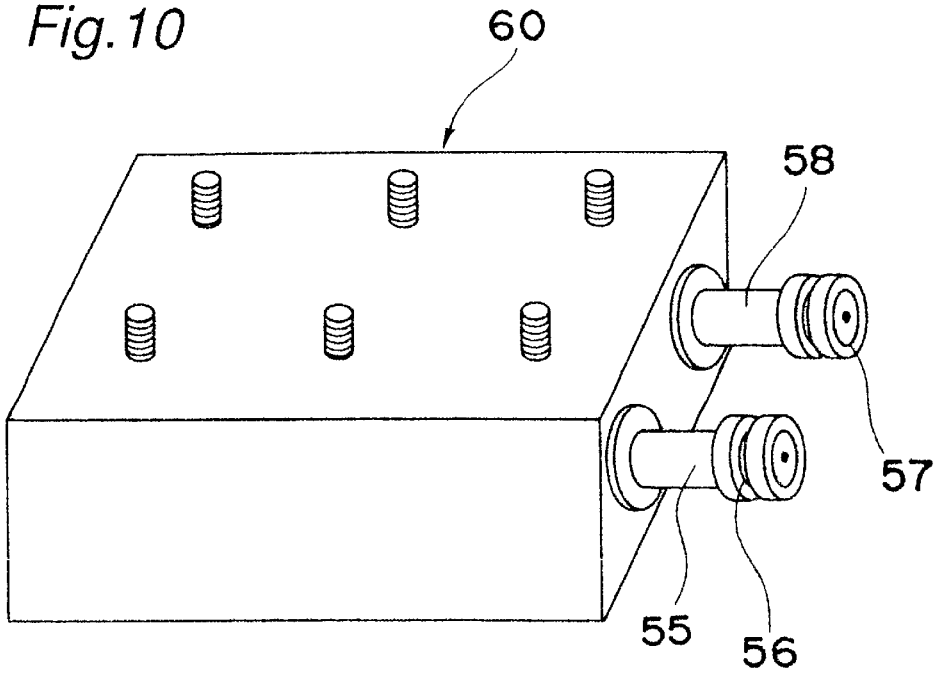
FIG. 10 is a perspective view of the dielectric filter according to the seventh embodiment.

FIG. 8 shows an example in which the frequency characteristics of a conventional dielectric filter and the frequency characteristics of dielectric filters according to the present invention are compared with each other. Here, as the conventional dielectric filter, a dielectric filter having the configuration shown in FIG. 10 is used. As the dielectric filters of the present invention, a dielectric filter having a configuration in which the two types of dielectric resonators having different shapes described in the embodiment 1 are used is compared with a dielectric filter having a configuration in which three types of dielectric resonators having different shapes described in Embodiment 6 are combined to each other. In FIG. 8, as transmission characteristics of the ordinate, the maximum value is set to be 0 dB, the minimum value is set to be −100 dB, and a desired passing band is set to be, e.g., 1.9 GHz. As is apparent from FIG. 8, according to the present invention, a multi-stage file is constituted by combining at least two types of dielectric resonators having different spurious characteristics, so that spurious suppressing characteristics which are better than those of a conventional multi-stage filter comprising dielectric resonators having single spurious characteristics. In addition, when three dielectric resonators having different shapes are used, a spurious frequency can be more shifted, and the levels of all spurious pulses can be suppressed in comparison with a case in which two dielectric resonators having different shapes are used.

Embodiment 7

The seventh embodiment of the present invention will be described below with reference to FIGS. 9 and 10. As described above, a spurious level appearing near a desired passing band can be suppressed by combining resonators having at least two types of different shapes or dielectric constants. However, an unnecessary wave appealing in a band higher than the desired passing band cannot be suppressed by only the above configuration. In this embodiment, in order to attenuate the unnecessary wave appearing in the higher band, a low-pass filter incorporated in a duct is connected and arranged.

Figure 9:
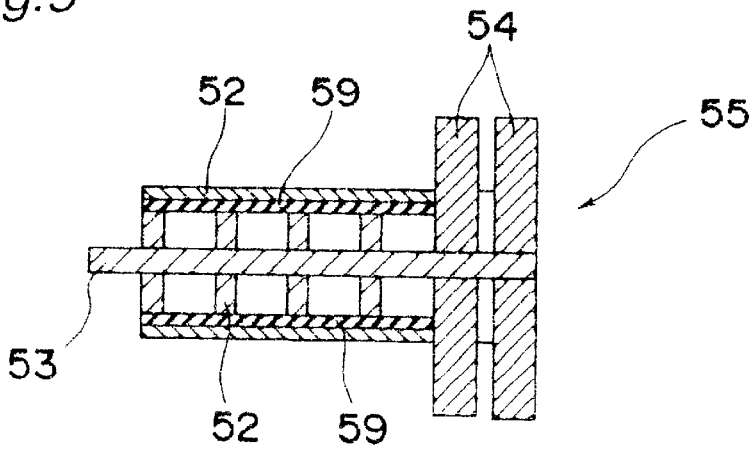
FIG. 9 is a sectional view of an LPF incorporated in a duct used in a dielectric filter according to the seventh embodiment of the present invention.

FIG. 9 is a sectional view of a low-pass filter (LPF) 55 incorporated in a duct and arranged between the dielectric filter and an input/output terminal in this embodiment. When the low-pass filter 55 is arranged, unnecessary resonance (not shown) appearing in a frequency band higher than the spurious band shown in FIG. 8 can be suppressed. In FIG. 9, inside an outer cylinder 51 constituted by a copper tube having an inner surface which is coated with an insulating material 59 such as polytetrafluorethylene (tradename: Teflon) or the like, an LPF formed by causing a shaft core 53 made of brass to penetrate the centers of a plurality of disk plates 52 made of brass is incorporated. Reference numeral 54 denotes a flange for connecting an external cable.

FIG. 10 is a perspective view showing a dielectric filter according to this embodiment. In FIG. 10, the LPF 55 shown in FIG. 9 is connected between a dielectric filter 60 and an input/output terminal 56 thereof, and a duct 58 for a transmission line is connected between the dielectric filter 60 and another input/output terminal 57, so that the dielectric filter according to this embodiment is constituted.

With only the low-pass filter (LPF) 55, a spurious pulse near a desired passing band cannot be suppressed or the characteristics of the LPF must be sharp, and therefore the loss increases. More specifically, when the dielectric filter according to the present invention and the LPF are combined with each other, a spurious pulse can be suppressed in a wide range.

Therefore, by using an LPF-incorporated dielectric filter according to this embodiment, spurious characteristics which are more suppressed can be obtained, and the dielectric filter can be reduced in size. In this embodiment, LPF can also be used in place of the duct 58, so that an unnecessary wave appearing in a higher band and a spurious pulse can be effectively suppressed.

Figure 11:
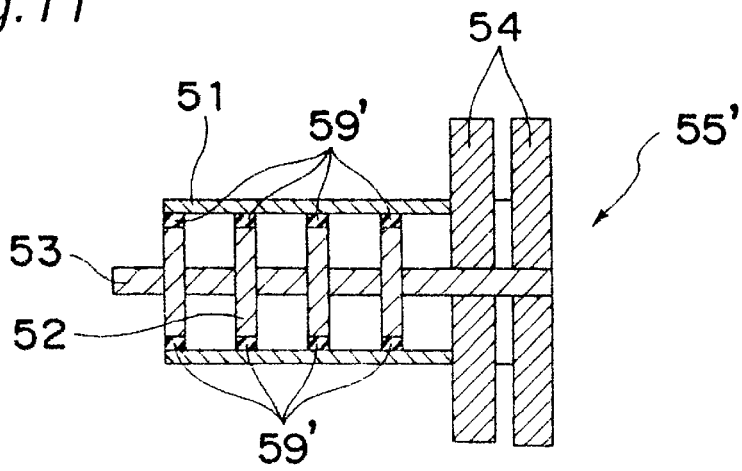
FIG. 11 shows a modification of the LPF incorporated in the duct according to the seventh embodiment of the present invention.

As a modification of the LPF shown in FIG. 9, in place of a Teflon film coated on the entire inner side of the outer cylinder 51, Teflon insulating members 59' are arranged at the peripheral portions of brass disk plates 52 as shown in FIG. 11 to integrate an LPF 55'. In this modification, the same effect can be obtained, and a reduction in weight can be achieved.

A cable or a duct for connecting an antenna or the like is connected to the input/output terminals 56 and 57. By using a duct having a diameter different from the diameters of the cable or the duct, a spurious frequency determined by the diameter of the duct can be controlled. When the diameter of the duct is decreased, the spurious frequency can be shifted to a higher band. For this reason, a spurious pulse can be suppressed to 13 GHz.

Embodiment 8

The eighth embodiment of the present invention will be described below. FIGS. 12(*a*) and 12(*b*) are a perspective view of a dielectric filter according to this embodiment and a sectional view of a main part of the dielectric filter. FIGS. 12(*a*) and 12(*b*) show a configuration in which, in a separate space, in addition to a tuning plate, adjusting screws (or metal rods) 92 are inserted at preferable positions near positions which are closer to a metal case 90 than a dielectric resonator 93. In this embodiment, the long metal screw 92 is inserted into a screw holes for connecting an upper bent end 90*a* of a metal housing 90 and a lid 91, and the length of the metal screw inserted into the separate space is adjusted.

The reason why the metal screw 92 is inserted at a position which is closer to the metal case 90 or the partition wall than the resonator 93 in the housing will be described below. Since an electromagnetic field strength in a $TE_{01\delta}$ mode sharply decreases when the horizontal distance from an end of the resonator increases, even though an adjusting screw is inserted at a position which is closer to the metal case or the partition wall than the resonator in the housing, the electromagnetic field in the $TE_{01\delta}$ mode is rarely affected, and a resonance frequency in the $TE_{01\delta}$ mode does not change. In contrast to this, the screw affects the electromagnetic field distribution in the other modes, the resonance frequency changes. In this manner, the electromagnetic distribution is changed while the transmission characteristics of a desired passing band and a band near the passing band are kept constant, and only the frequency of an unnecessary spurious pulse can be shifted. In this manner, overlapping spurious frequencies at a high level can be dispersed, and the levels of all spurious pulses can be considerably suppressed.

In this case, even though the metal screw 92 for changing only the frequency of a spurious pulse is not inserted into a screw hole for connecting the metal housing 90 and the lid 91, the same effect as described above even in a configuration in which the insertion length of a metal rod inserted into a separate space is simply adjusted, as a matter of course.

INDUSTRIAL APPLICABILITY

As is apparent from the embodiments described above, according to the present invention, when dielectric resonators having at least two types of different shapes or different dielectric constants are arranged in spaces partitioned by partition walls in a shielding unit constituted by a metal case and a lid, excellent spurious suppressing characteristics can be obtained, and insertion loss can be reduced.

What is claimed is:

1. A dielectric filter having a metal case, a metal lid, a plurality of dielectric resonators mounted on support members in spaces partitioned by a metal partition wall inside said metal case, and metal tuning plates positioned above said plurality of dielectric resonators to adjust resonance frequencies of said plurality of dielectric resonators, wherein coupling degrees between said plurality of dielectric resonators are adjusted by gaps between said metal case and said metal partition wall and adjusting screws extending into said gaps, and wherein the dielectric filter comprises a combination of at least two types of dielectric resonators having different frequency characteristics in unnecessary spurious modes except for a the $TE_{01\delta}$ mode which is a main mode of a passing band of said dielectric filter, so that said unnecessary spurious modes of said plurality of dielectric resonators are adjustable by metal rod members provided at positions near a wall surface inside said metal case, wherein said dielectric resonators having different frequency characteristics in said unnecessary spurious modes comprise a combination of dielectric resonators having at least two different shapes, and wherein said dielectric resonators comprise a dielectric resonator with an inner hole and a dielectric resonator without an inner hole.

2. The dielectric filter of claim 1, wherein said dielectric resonators having different frequency characteristics in unnecessary spurious modes comprise a combination of dielectric resonators having at least two different dielectric constants.

3. A dielectric filter having a metal case, a metal lid, a plurality of dielectric resonators mounted on support members in spaces partitioned by a metal partition wall inside said metal case, and metal tuning plates positioned above said plurality of dielectric resonators to adjust resonance frequencies of said plurality of dielectric resonators, wherein coupling degrees between said plurality of dielectric resonators are adjusted by gaps between said metal case and said metal partition wall and adjusting screws extending into said gaps, and wherein the dielectric filter comprises a combination of at least two types of dielectric resonators having different frequency characteristics in unnecessary spurious modes except for a the $TE_{01\delta}$ mode which is a main mode of a passing band of said dielectric filter, so that said unnecessary spurious modes of said plurality of dielectric resonators are adjustable by metal rod members provided at positions near a wall surface inside said metal case, wherein said dielectric resonators having different frequency characteristics in said unnecessary spurious modes comprise a combination of dielectric resonators having at least two different shapes, and wherein said dielectric resonators have inner holes having at least two different diameters.

4. The dielectric filter of claim 3, wherein said dielectric resonators having different frequency characteristics in unnecessary spurious modes comprise a combination of dielectric resonators having at least two different dielectric constants.

5. A dielectric filter having a metal case, a metal lid, a plurality of dielectric resonators mounted on support members in spaces partitioned by a metal partition wall inside said metal case, and metal tuning plates positioned above said plurality of dielectric resonators to adjust resonance frequencies of said plurality of dielectric resonators, wherein coupling degrees between said plurality of dielectric resonators are adjusted by gaps between said metal case and said metal partition wall and adjusting screws extending into said gaps, and wherein the dielectric filter comprises a combination of at least two types of dielectric resonators having different frequency characteristics in unnecessary spurious modes except for a the $TE_{01\delta}$ mode which is a main mode of a passing band of said dielectric filter, so that said unnecessary spurious modes of said plurality of dielectric resonators are adjustable by metal rod members provided at positions near a wall surface inside said metal case, wherein said plurality of dielectric resonators are supported by cylindrical support members having at least two different thicknesses.

6. A dielectric filter having a metal case, a metal lid, a plurality of dielectric resonators mounted on support members in spaces partitioned by a metal partition wall inside said metal case, and metal tuning plates positioned above said plurality of dielectric resonators to adjust resonance frequencies of said plurality of dielectric resonators, wherein coupling degrees between said plurality of dielectric resonators are adjusted by gaps between said metal case and said metal partition wall and adjusting screws extending into said gaps, and wherein the dielectric filter comprises a combination of at least two types of dielectric resonators having different frequency characteristics in unnecessary spurious modes except for a the $TE_{01\delta}$ mode which is a main mode of a passing band of said dielectric filter, so that said unnecessary spurious modes of said plurality of dielectric resonators are adjustable by metal rod members provided at positions near a wall surface inside said metal case, wherein said plurality of dielectric resonators comprise a combination of at least two different aspect ratios, one of a presence and an absence of inner holes and diameters of the inner hole, dielectric constants, and a thickness of cylindrical support members.

7. A dielectric filter having a metal case, a metal lid, a plurality of dielectric resonators mounted on support members in spaces partitioned by a metal partition wall inside said metal case, and metal tuning plates positioned above said plurality of dielectric resonators to adjust resonance frequencies of said plurality of dielectric resonators, wherein coupling degrees between said plurality of dielectric resonators are adjusted by gaps between said metal case and said metal partition wall and adjusting screws extending into said gaps, and wherein the dielectric filter comprises a combination of at least two types of dielectric resonators having different frequency characteristics in unnecessary spurious modes except for a the $TE_{01\delta}$ mode which is a main mode of a passing band of said dielectric filter, so that said unnecessary spurious modes of said plurality of dielectric resonators are adjustable by metal rod members provided at positions near a wall surface inside said metal case, wherein said metal case and at least one of an input and an output terminal are connected to a first duct, and a low-pass filter is provided in said first duct with an inner diameter smaller than an inner diameter of a second duct for use as an input and output portion.

* * * * *

UNITED STATES PATENT AND TRADEMARK OFFICE

CERTIFICATE OF CORRECTION

PATENT NO. : 6,707,353 B1
DATED : March 16, 2004
INVENTOR(S) : T. Yamakawa et al.

It is certified that error appears in the above-identified patent and that said Letters Patent is hereby corrected as shown below:

Title page,
Item [57], ABSTRACT,
Line 3, after "pulse" insert -- which --.
Line 4, before "frequency" insert -- same --.

Column 10,
Lines 34 and 63, change "a the" to -- a --.

Column 11,
Line 24, change "a the" to -- a --.

Column 12,
Lines 5 and 28, change "a the" to -- a --.

Signed and Sealed this

Thirty-first Day of August, 2004

JON W. DUDAS
*Director of the United States Patent and Trademark Office*